US006769408B2

(12) United States Patent
Krome et al.

(10) Patent No.: US 6,769,408 B2
(45) Date of Patent: Aug. 3, 2004

(54) HOLD-DOWN METAL PLATE FOR SECURING A FUEL INJECTION VALVE

(75) Inventors: Juergen Krome, Schlangen (DE); Ferdinand Reiter, Markgroeningen (DE); Jens Pohlmann, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/258,321

(22) PCT Filed: Feb. 21, 2002

(86) PCT No.: PCT/DE02/00643

§ 371 (c)(1),
(2), (4) Date: Mar. 14, 2003

(87) PCT Pub. No.: WO02/066821

PCT Pub. Date: Aug. 29, 2002

(65) Prior Publication Data

US 2003/0154960 A1 Aug. 21, 2003

(30) Foreign Application Priority Data

Feb. 21, 2001 (DE) ..... 101 08 190

(51) Int. Cl.[7] ..... F02M 7/00
(52) U.S. Cl. ..... 123/470; 123/471
(58) Field of Search ..... 123/470, 471, 123/445, 469

(56) References Cited

U.S. PATENT DOCUMENTS

| | | | | |
|---|---|---|---|---|
| 5,520,151 A | * | 5/1996 | Gras et al. | 123/470 |
| 5,566,658 A | * | 10/1996 | Edwards et al. | 123/470 |
| 6,431,152 B1 | * | 8/2002 | Estacio | 123/470 |

FOREIGN PATENT DOCUMENTS

| | | |
|---|---|---|
| DE | 197 35 665 | 1/1999 |
| JP | 08 312 503 | 11/1996 |
| JP | 11 101 170 | 4/1999 |
| JP | 2000 120 508 | 4/2000 |
| JP | 2000 145 579 | 5/2000 |
| WO | WO 98 53197 | 11/1998 |

* cited by examiner

*Primary Examiner*—Bibhu Mohanty
(74) *Attorney, Agent, or Firm*—Kenyon & Kenyon

(57) ABSTRACT

A holding down plate for fastening a fuel injector in a location orifice of a cylinder head of a mixture-compressing internal combustion engine includes on one end a fastening bore, which is penetrated by a fastening element which fastens the holding down plate to the cylinder head, and the opposite end of the holding down plate has a location orifice for receiving a fuel injector, the location orifice being divided by an insertion recess and delimited by a first and a second fork end, which exert a force on the fuel injector thereby pressing the fuel injector against a pressure shoulder located in the location orifice of the cylinder head. The first and the second fork end are bent in a shape that is undulated in cross-section and is oriented toward the fuel injector, a radius of the undulated bending each forming a support area.

9 Claims, 2 Drawing Sheets

HOLD-DOWN METAL PLATE FOR SECURING A FUEL INJECTION VALVE

FIELD OF THE INVENTION

The present invention relates to a holding down plate for fastening of a fuel injector.

BACKGROUND INFORMATION

For receiving a fuel injector, direct-injection internal combustion engines usually have a location bore in a cylinder head in which a pressure shoulder is formed, against which the fuel injector is pressed using a clamping claw or a holding down plate. Such a clamping claw is known from Unexamined Japanese Patent Application No. 08-31 25 03.

Due to the non-symmetry of the applied force, transverse forces occur in the fuel injector, resulting in stresses which may cause interference and even failure of the system during operation of the fuel injector.

SUMMARY OF THE INVENTION

The holding down plate according to the present invention has the advantage over the related art in that the force is applied symmetrically due to the bent fork ends. The force is applied along a support line which is symmetrical with regard to the longitudinal axis of the fuel injector.

The linear support areas of the bent fork ends lie on a common straight line, so that the holding down plate may be oriented in any desired way with regard to a symmetrically designed fuel injector. By introducing a slot which starts at the location orifice it is possible to produce two independently formed bending bars whose elasticity determines the support force in the support area. By introducing the slot asymmetrically, it is further possible to influence the spring constant of the particular bending bar according to the length of the bending bars up to the support area, so that the same force is always applied to the fuel injector in the support area. Thereby the introduction of transverse forces into the fuel injector can be prevented. The spring-elastic fork ends make an axial length compensation possible. Thus tolerances occurring during manufacture as well as the elongation due to temperature differences occurring during operation can be compensated for.

DETAILED DESCRIPTION

Figure 1:
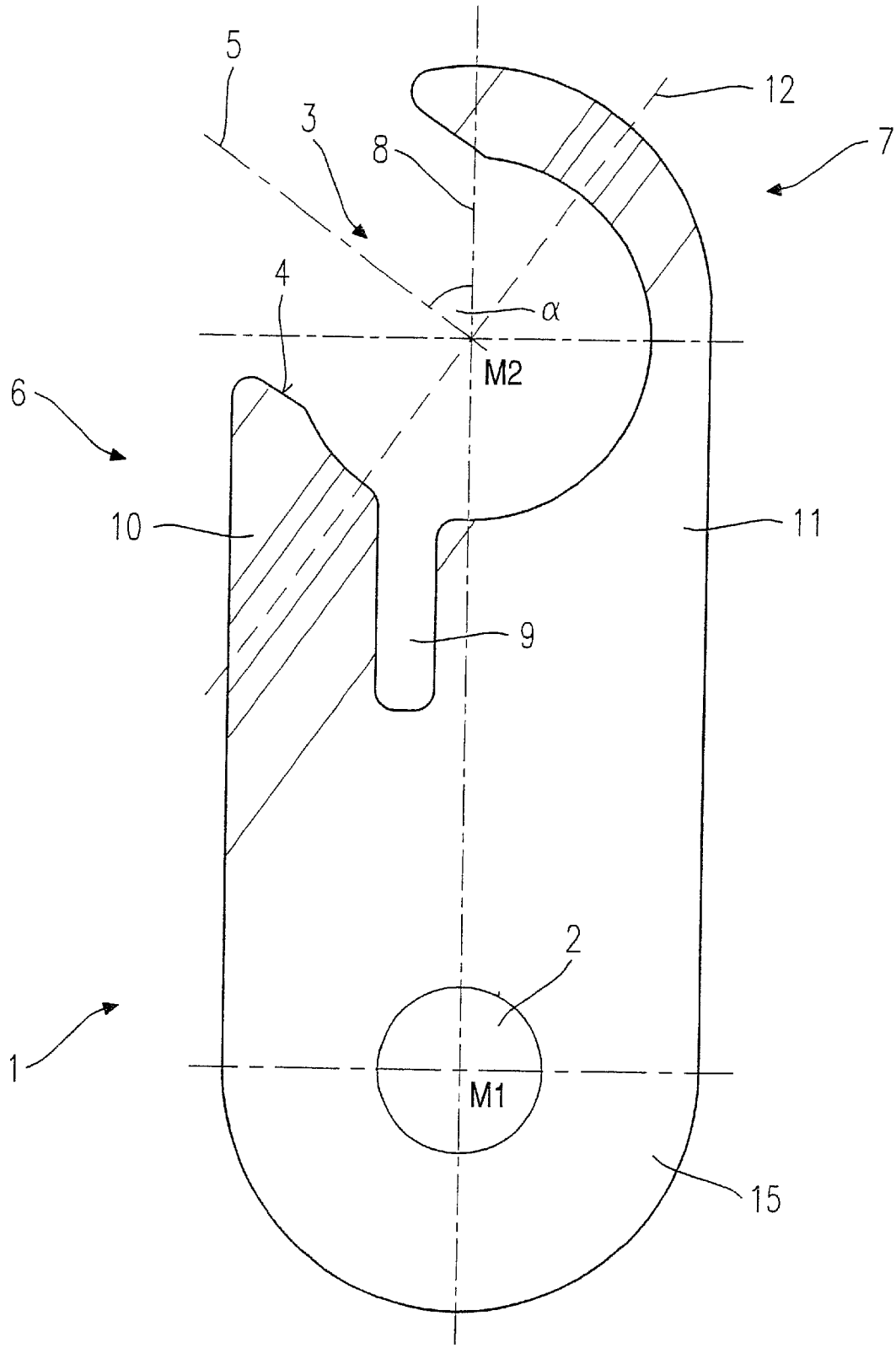
FIG. 1 shows a top view of a holding down plate according to the present invention.

A holding down plate 1 is illustrated in FIG. 1 in a top view. Holding down plate 1 has essentially an oblong basic geometry, both small faces being semicircularly rounded. At one end holding down plate 1 has a fastening bore 2, whose center M1 is identical to the center of the semicircular rounding. Fastening bore 2 is used for receiving a fastening element, a screw for example, which is screwed into the cylinder head (not shown) and thereby securing holding down plate 1.

A location orifice 3 is introduced into holding down plate 1 at the diametrically opposed end of holding down plate 1; the center M2 of location orifice 3 is also situated on longitudinal axis 8 of holding down plate 1. In order to simplify the assembly, location orifice 3 has an insertion recess 4, whose center line 5 runs through center M2 of location orifice 3. Center line 5 of insertion recess 4 forms an insertion angle a which is different from zero with longitudinal axis 8 of holding down plate 1. Insertion recess 4 makes it possible to install holding down plate 1 even when the fuel line is installed. Insertion angle $\alpha$ is determined by the amount of space available on the particular engine.

Figure 2:
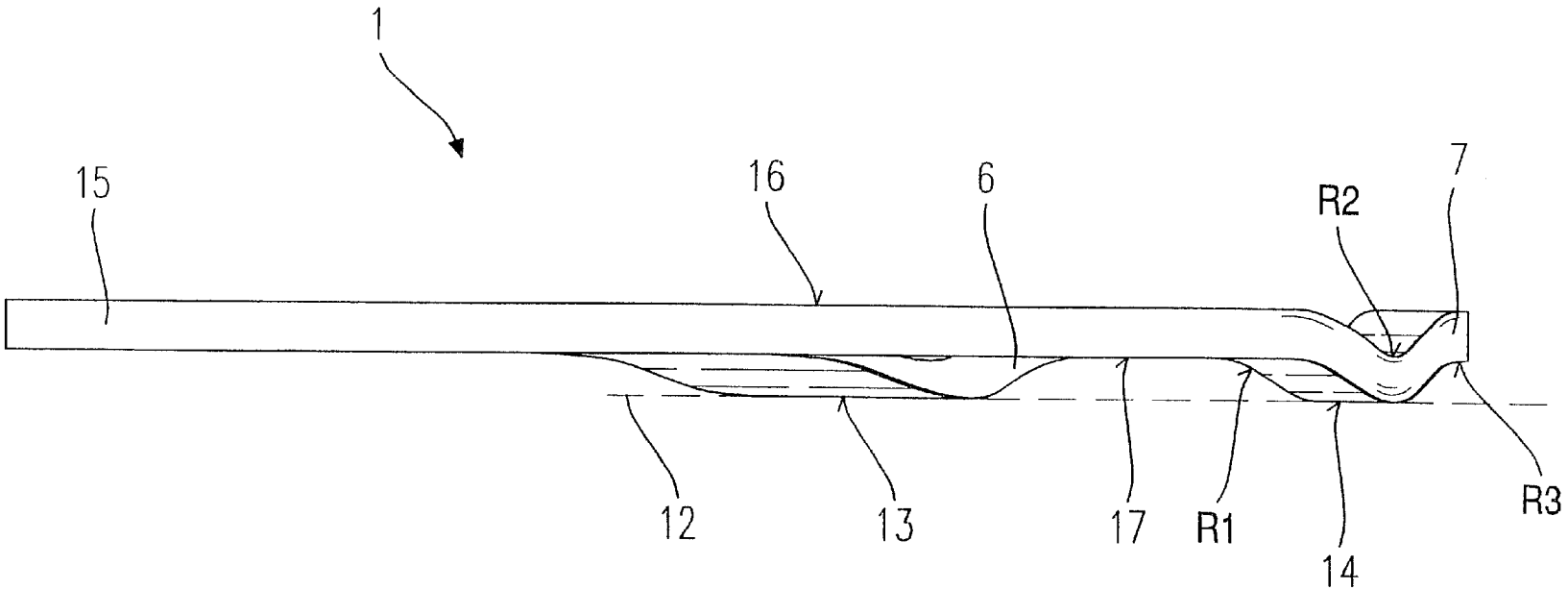
FIG. 2 shows a side view of a holding down plate according to the present invention from FIG. 1.

According to the position of center line 5 of insertion recess 4 the injector-side end of holding down plate 1 is divided in a bifurcate manner and forms a first fork end 6 and a second fork end 7. First fork end 6 and second fork end 7 have different lengths, whose relationship depends on the width of insertion recess 4 and the position of center line 5 of insertion recess 4. First fork end 6 and second fork end 7 are bent so that each forms a support line, which have a common connecting line 12, which runs through center M2 of location orifice 3 and preferably forms a right angle with center line 5 of insertion recess 4. Center M2 of location orifice 3 coincides with the longitudinal axis of the fuel injector (not shown) which is perpendicular to the drawing plane. The design of bent fork ends 6 and 7 is described below on the basis of FIG. 2.

In order to prevent stresses in the fuel injector, it is necessary to provide the same pressure force by both fork ends 6 and 7. To achieve this, a slot 9 is introduced into holding down plate 1, the slot starting from location orifice 3 being situated, for example, parallel to longitudinal axis 8 of holding down plate 1. Slot 9 divides holding down plate 1 into a first bending bar 10 and a second bending bar 11. The spring characteristic curves of first bending bar 10 and second bending bar 11 are determined by the distance of slot 9 from longitudinal axis 8 of holding down plate 1 as well as the width and length of slot 9. The spring parameters of first bending bar 10 and second bending bar 11 are set such that the forces introduced into the fuel injector by first fork end 6 and second fork end 7 are the same. This makes it possible to compensate for the effect of the varying length of the bending lengths of first fork end 6 and second fork end 7.

For clarification of the bending profile of bent fork ends 6 and 7, holding down plate 1 is illustrated in FIG. 1 in a side view. Both fork ends 6 and 7 are preferably shaped jointly so that they have an identical profile which will be explained on the basis of second fork end 7. The shape of both fork ends 6 and 7 is described by three radii. Starting from the sides of a flat section 15, with which holding down plate 1 is fastened on a fastening face of the cylinder head, fork end 7 is bent in the direction of fuel injector side 17 of holding down plate 1, with a first radius R1. Subsequently, second fork end 7 is bent in the opposite direction with radius R2, ending after a radius R3, which is oriented as first radius R1, i.e., again on the level of flat section 15. Thus, a flat face results on side 16 facing away from the fuel injector. At least radius R1 and third radius R3 are preferably equal, and the bending lines of the three radii R1 through R3 run parallel to one another. The two support areas 13 and 14 are formed on fuel injector side 17 of second radius R2.

If first fork end 6 and second fork end 7 are shaped jointly, the first support area 13 and second support area 14 will be automatically situated on a straight line 12. Hereby, connecting straight line 12 runs parallel to fuel injector side 17 of holding down plate 1. Support areas 13 and 14 of fork ends 6 and 7 may be oriented so that they run neither parallel nor at a right angle to longitudinal axis 8 of holding down plate 1. Fork ends 6 and 7 may be designed asymmetrically.

Holding down plate 1 may be cost-effectively manufactured as a punched bending part, for example. An axial tolerance compensation of the fuel injector is made possible by using spring-elastic fork ends 6 and 7.

What is claimed is:

1. A holding down plate for fastening a fuel injector in a location orifice of a cylinder head of a mixture-compressing internal combustion engine, comprising:

a body including at one end a fastening bore that is penetrated by a fastening element in order to fasten the holding down plate to the cylinder head, wherein:

an opposite end of the body includes a location orifice for receiving the fuel injector, the location orifice is divided by an insertion recess and delimited by a first fork end and a second fork end that exert a force on the fuel injector, pressing the fuel injector against a pressure shoulder located in a location bore of the cylinder head, and each one of the first fork end and the second fork end is bent in a shape that is undulated in cross-section to produce an undulated bending and is oriented toward the fuel injector, each radius of the undulated bending forming a support area so that a first support area and a second support area respectively correspond to the first fork end and the second fork end.

2. The holding down plate as recited in claim 1, wherein:

the first support area and the second support area are situated on a common connecting straight line.

3. The holding down plate as recited in claim 2, wherein:

the common connecting straight line has a point of intersection with a longitudinal axis of the fuel injector.

4. The holding down plate as recited in claim 2, wherein:

the common connecting straight line is perpendicular to a normal of a plane of the holding down plate.

5. The holding down plate as recited in claim 1, wherein:

the first support area and the second support area are perpendicular to a center line of the insertion recess.

6. The holding down plate as recited in claim 1, wherein:

the body includes a slot starting from the location orifice, the slot is positioned asymmetrically with respect to a longitudinal axis of the holding down plate, and the slot forms a bending bar for each one of the first fork end and the second fork end.

7. The holding down plate as recited in claim 6, wherein:

due to an asymmetry of the bending bars, different bending lengths of the first fork end and the second fork end are compensatable so that forces transmitted to the fuel injector in the first support area and the second support area are identical for the first fork end and the second fork end.

8. The holding down plate as recited in claim 2, wherein:

the first support area and the second support area are oriented so that the first support area and the second support area run neither parallel nor at a right angle to a longitudinal axis of the holding down plate.

9. The holding down plate as recited in claim 2, wherein:

the first fork end and the second fork end are asymmetrical.

* * * * *